United States Patent [19]

Naderi

[11] Patent Number: 4,793,152

[45] Date of Patent: Dec. 27, 1988

[54] EVAPORATIVE COOLER WITH VENTILATIVE DEVICE

[76] Inventor: Mohammod T. Naderi, Escamplaan 23, The Hague, Netherlands

[21] Appl. No.: 717,433

[22] Filed: Jun. 24, 1985

[51] Int. Cl.[4] ..... F28D 5/00

[52] U.S. Cl. ..... 62/311; 62/314

[58] Field of Search ..... 62/304, 309, 314, 311, 62/171

[56] References Cited

U.S. PATENT DOCUMENTS 4,023,949 5/1977 Schlom et al. ..... 62/314

4,429,735 2/1984 Nomaguchi et al. ..... 62/304

FOREIGN PATENT DOCUMENTS 5774582 5/1982 Japan ..... 62/304

*Primary Examiner*—Henry A. Bennet

[57] ABSTRACT

Fresh inlet air is precold by the cool air discharging from the enclosure by the means of a heat exchanger to become still colder as the result of evaporation inside the evaporative cooler so producing useful air colder and with less water than conventional evaporative cooler. A heat exchanger is disclosed which comprises of numerous exhaust and suction canals adjacent to each other in which is provided aluminium lace for the purpose of exchanging the heat. The cool discharged air passes through the exhaust canals and leaves the heat exchanger cool to outside space and inlet fresh air passes through the suction canals separately relationship with discharged air and after becoming cool leaves the heat exchanger inside the evaporative cooler to effect evaporation.

3 Claims, 4 Drawing Sheets

EVAPORATIVE COOLER WITH VENTILATIVE DEVICE

BACKGROUND OF THE INVENTION (1) Field of Invention

Conventional evaporative cooler operates by using directly outside air. As the result in high temperature the useful air will not be cold enough and because of high temperature of the useful air and its content of moisture the occupant of an enclosure will not experience great degree of comfort. Also as the useful air should be discharged from the enclosure because of the high pressure of the air and this air discharging from the enclosure is colder as compared with outside air, so energy is wasted. But even now from the point of less energy cost in comparison with some other cooling devices and also because of possibility to produce it in big and small size and making the air fresh and clean, the evaporative cooler is the most useful device. For this reason removing deficiency of evaporative cooler is a very important matter.

(2) Description of the Prior Art

For the purpose of removing the deficiency of the evaporative cooler a variety of designs have been proposed wherein the heat absorptive action of evaporative is employed to reduce the temperature of a heat exchanger apparatus and the fresh air is then passed through the heat exchanger apparatus for purpose to be cold. The air which is used to effect evaporation (working air) is conducted to the atmosphere and the useful air is directed into the room. In this way effort is made to remove the deficiency of the evaporative cooler. In these designs wasting of energy is high and useful air is not fresh and with water vapor and enough coldness. At 5/11/72 the design No. 10584 was proposed and patented by the inventor of the present invention wherein a portion of the useful air was employed to reduce the temperature of a heat exchanger apparatus and the inlet fresh air by passing through the said heat exchanger was precold before to be employed as working air for evaporation and as the result the cooler produced useful air colder and with less water vapor in comparison with ordinary evaporative cooler. Although this invention was useful, because of low efficiency of the heat exchanger and using a portion of the useful air, the waste of energy was high to some extent. Then other designs have been proposed wherein the indoor air which was precold by passing through a heat exchanger was employed as working air for evaporation. So the working air (the indoor air) was precold before being employed for evaporation and this precold indoor air after again being cooled inside the device by evaporation was used to reduce the temperature of the heat exchanger in which the outdoor air passed for being cooled and entering the room. The heat exchanger which is used in these design is made by laminating of corrugated plates between flat plate to have two air flows crossing orthogonally. These heat exchanger has nothing in their canals to help the exchange of the heat and corrugate plates which cause the air passing through the canals only in one side has enough contact with the adjacent wall. This heat exchanger which is used inside the air condition has limit heat exchanging surface and makes the entire system big and as the air employing for evaporation exhaust near the ports in which the inlet fresh air is sucked, it needs dehumidifying system and as the result the air of the enclosure would not be pleasant.

These designs not being simple as evaporative cooler nevertheless change the nature of evaporative cooler because in these designs outdoor fresh air is not employed as working air to produce useful air fresh, cold clean with water vapor as is true with evaporative cooler. So none of these designs could replace evaporative cooler completly, the reason being that although above mentioned designs have some privileges they do not hold special privileges of the evaporative cooler like simplicity and less cost of energy and inexpensive and also making the air cold clean with water vapor which is desirable in the dry climate. In these designs the working air which leaves the device to atmosphere is colder than the outside temperature so a lot of energy is wasted. The evaporative cooler is a useful device; its problem is that when the weather is too hot the water vapor of the useful air is high and the useful air is not cold enough. Another important deficiency of the evaporative cooler is that when as the result of the high air pressure the useful air leaves the room it takes coldness generated by the evaporative cooler to outside, so the energy is wasted.

The present invention satisfies the foregoing deficiency of the evaporative cooler without having much energy cost and even in some instances without further energy cost.

SUMMARY OF INVENTION

The invention which is here disclosed shows an evaporative cooler with a reverse canal and a heat exchanger. The precooled air of the enclosure is conducted on the top of the heat exchanger by the reverse canal and the said air after passing through the heat exchanger and making it cool leaves the heat exchanger to atmosphere and the fresh inlet air by passing through the heat exchanger (separately independent with the indoor air which exhaust through the heat exchanger) is heat removed (precold) to be still colder by evaporation inside the evaporative cooler.

A heat exchanger here is disclosed with canals wide enough to let the air pass through them very easily meanwhile with highly heat exchange efficiency which could be manufactured very easily by very thin aluminum sheet also it could be manufactured easily with numerous canals with enough surface for good heat exchanging process. Aluminum folded sheet lace is provided in the said canals which by its wires which are parallel to the walls of the canals will conduct the air toward the walls of the canals and also with its wires which extend between the walls of the canals exchanges the heat between the canals and with its wires attached to the canals wall make a rough surface on them thus providing desirable heat transfer gradient and as the result heat exchanging process is performed very efficiently. The heat exchanger consist of numerous canals. The walls of the adjacent canals are the same and the canals are separated from each other so the air passing through the canals are separated and as the result heat exchanging process between the inlet fresh air and the air discharging from enclosure passing through adjacent canals is performed without addition of water vapor to the inlet fresh air, consequently just before entering the cooler the inlet air loses some of its temperature to become still colder by evaporation inside the evaporative cooler. Thus the device helps the cooler exit the useful air colder and with less water vapor than conventional evaporative cooler and prevents wasting of energy.

DESCRIPTION OF THE PREFERRED EMBODIMENT

As it was described before the system comprises of a conventional evaporative cooler and a reverse canal and a heat exchanger.

Figure 1:
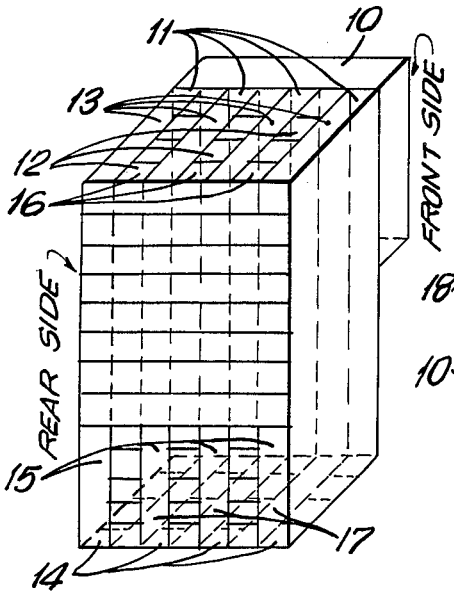
FIG. 1 shows the evaporative cooler with reverse canal which is inserted the room through the opening of a partition.

Referring to FIG. 1 of the drawings there is illustrated a conventional evaporative cooler 10 with reverse canal 11 and the opening of a partition 12 (the partition separates the indoor side from the outdoor side) through which the front part of the evaporative cooler 13 and the front part of the reverse canal 14 inserted into the room. The cooler includes a plurality of exhaust ports disposed on the surface of the front side of the evaporative cooler 15 in the indoor side and a plurality of suction ports disposed on surface of the rear side of the evaporative cooler 16 in the outdoor side. The construction of the evaporative cooler is well known and it is not necessary to be described. The fresh outdoor air is sucked into the evaporative cooler through the plurality of the suction ports 16 (as is shown by the left hand arrow). When the fresh outdoor air which is sucked inside the evaporative cooler has heat removed inside the cooler due to the heat of evaporative required for the water to be vaporized, thereby to provide the useful air having a lower temperature than the outdoor air. Then the useful air through exhaust ports 15 (as is shown by the left hand arrow) is delivered to the room. But the useful air introduced to the room after making the room cool by the pressure of the air accumulation should escape to outdoor. So by the assumption that there is no other hole in the room except reverse canal 11 the indoor air escapes from the room through the reverse canal 11 (as is shown by the right hand arrow). If there is another hole in the room an air blower should be provided inside the reverse canal 11 to push the indoor air inside the reverse canal. The vertical front side of the reverse canal 14 is open and the vertical end of the reverse canal 17 is closed and the horizontal beneath end of the reverse canal 18 is open so the air escaping the room through the reverse canal from the horizontal beneath open part of the reverse canal 18 will flow down (as is shown by the downward arrow).

Figure 2:
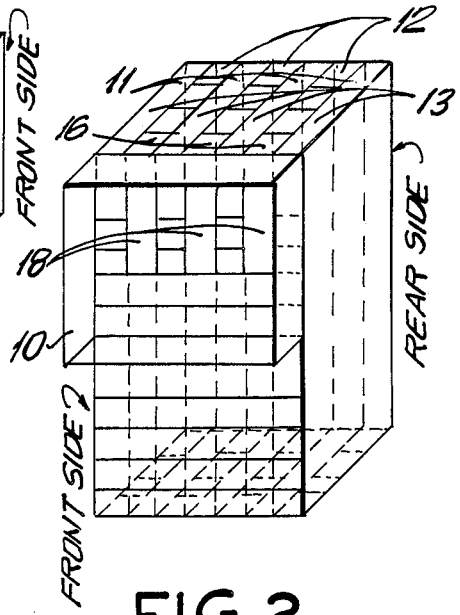
FIG. 2 shows the heat exchanger from the rear side.
Figure 3:
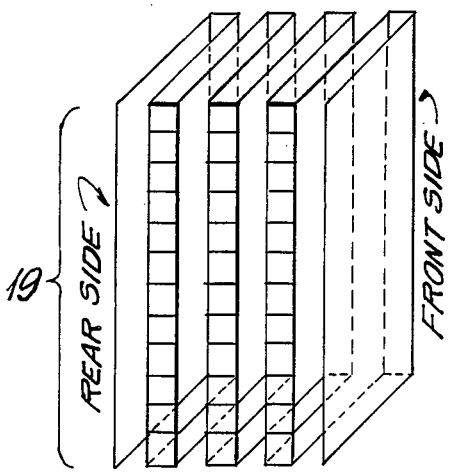
FIG. 3 shows the heat exchanger from the front side (the front side is fixed on the back of the evaporative cooler).

Reffering to FIGS. 2 and 3 there are illustrated the heat exchanger from rear side and front side. FIG. 2 shows the heat exchanger from the rear side and FIG. 3 shows the heat exchanger from the front side. The heat exchanger comprises of the exhaust canals 19 and the suction canals 20 and a case 21 in which the canals 19 and 20 are fixed (it will be described more particularly later). The walls of the case 22 are longer than the canals 19 and 20 except in the front side 23. In the front side of the heat exchanger (on the case) there is provided a frame 24 which will be fixed on the back of the cooler 25 in FIG. 1 to cover the suction ports 16 in FIG. 1. The horizontal open beneath end of the reverse canal 18 in FIG. 1 is fixed on the top of the heat exchanger 26 so the indoor air flowing down through the horizontal open beneath end of the reverse canal 18 in FIG. 1 passes through the heat exchanger.

The heat exchanger consists of multitude of exhaust canals 19 and suction canals 20. The heat exchanger are so designed as there is a exhaust canal 19 next to a suction canal 20 in such a way that the air flow in the exhaust canals 19 are kept effectively independent from the air flow in the suction canals 20 (it will be described more particularly in the detailed construction). There are provided aluminum lace in the canals which helps exchanging of the heat between the canals (aluminum lace provided in the canals are not illustrated for the purpose of keeping the drawings simple). The exhaust canals 19 are open on the top 19 but closed on the bottom 27 and are connected to the exhaust outlet opening 28. The suction canals 20 are closed on the top 29 and are open on the bottom 20 and are connected to the suction inlet opening 30.

Figure 4:
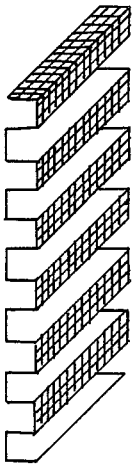
FIG. 4 shows the air flow in an exhaust canal.

Reffering to FIG. 4 the air flow in one exhaust canal is shown. As it could be seen in the direction of arrow the air enters the exhaust canal from its top 19 which is open and after passing through the exhaust canal 19 leaves the canal through exhaust outlet opening 28.

Figure 5:
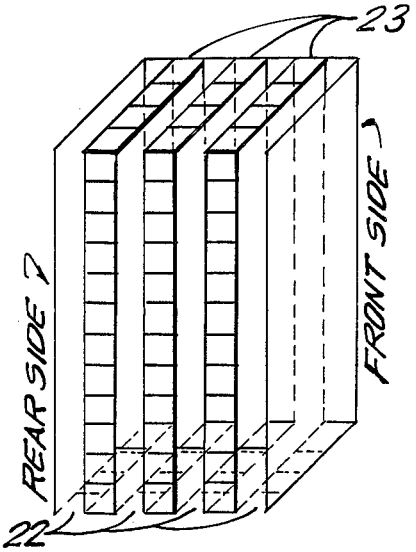
FIG. 5 shows the air flow in a suction canal.

Referring to FIG. 5 the air flow in one suction canal is shown. As it could be seen in the direction of arrow the air is sucked from the bottom of the suction canal 20 which is open and after passing through the suction canal leaves the suction canal through its suction inlet opening 30.

Figure 6:
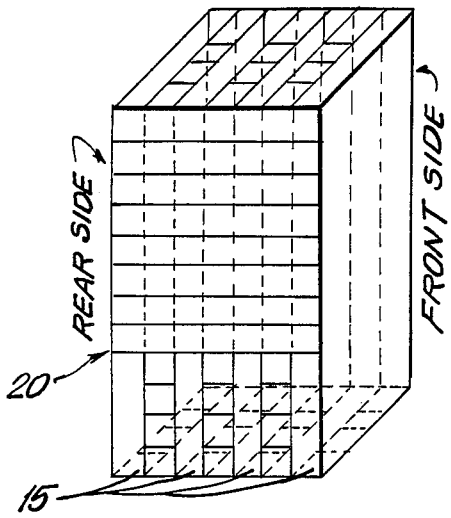
FIG. 6 shows the complete arrangement.

Reffering to FIG. 6 the complete arrangement is illustrated, which comprises a conventional evaporative cooler 10 a reverse canal 11 a partition 12 through which the front part of the evaporative cooler 13 and the front part of the reverse canal 14 are inserted inside the room and a heat exchanger 31. The frame on the front side of heat exchanger 24 is fixed to the back of evaporative cooler 25 to cover the suction ports. If the evaporative cooler also sucks the air from the sides the heat exchanger should also be fixed on the sides (the heat exchanger fixed on the sides and the suction ports which is covered by the frame 24 are not illustrated for the purpose of keeping the drawings simple). Top of the heat exchanger 26 is fixed to the horizontal open beneath of the reverse canal 18. If the evaporative cooler sucks the air from the sides and as the result the heat exchanger is also fixed on the sides the reverse canal should also be fixed on the heat exchanger which are fixed on the sides (the reverse canal fixed on the heat exchanger which are fixed on the sides of the evaporative cooler are not illustrated for the purpose of keeping the drawing simple). In operation the indoor air enters the reverse canal 11 through its open front side 14 and by passing the reverse canal 11 (as is shown by right hand arrow) through its horizontal beneath open end 18 enters the exhaust canal 19 and after passing the exhaust canals leaves the exhaust canals through the exhaust outlet opening 28 and as the result makes the heat exchanger cool. The direction of the air flow through the last exhaust canal from the left side 19 and through its exhaust outlet opening 28 is shown by arrow (direction of the air flow in the other exhaust canals and exhaust valves are not illustrated for the purpose of keeping the drawing simple). The fresh out door air through the bottom of suction canals 20 which are open is sucked inside the suction canals 20 and after passing through suction canals 20 and is heat removed (because heat exchanger is cooled) enters the evaporative cooler through the suction melt opening 30 to become still colder by evaporation inside the evaporative cooler. The air flow through the last suction canal from the right side 20 and its suction inlet opening 30 is shown by arrow (direction of air flow in the other suction canals 20 and other suction valves 30 are not illustrated for the purpose to keep the drawing simple).

Figure 7:
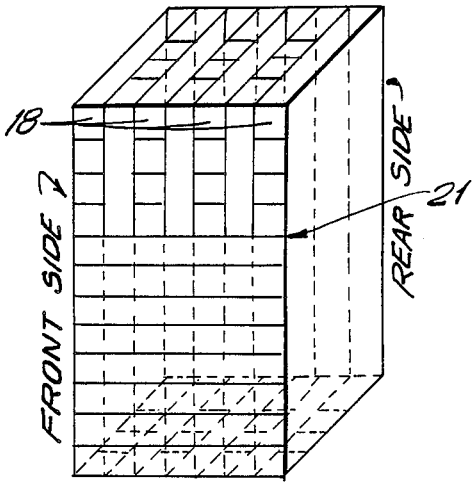
FIG. 7 shows aluminum sheet which is folded to make the canals in beginning stage.
Figure 8:
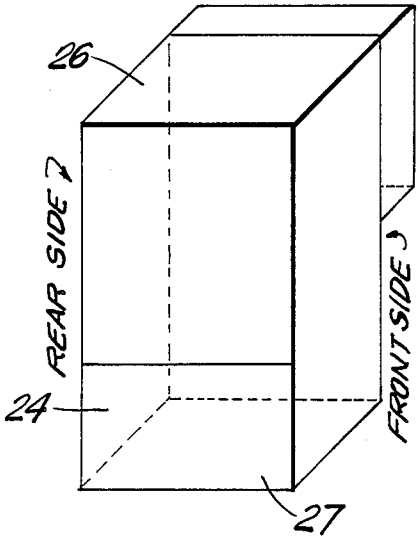
FIG. 8 shows the aluminum sheet lace which will be inserted in the canal.
Figure 9:
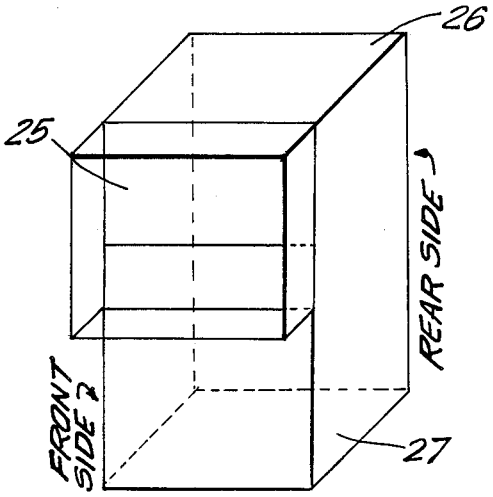
FIG. 9 shows FIG. 7 when the bottom of the exhaust canals and the top of the suction canals are closed (the aluminum sheet lace inserted in the canals are not illustrated for the purpose of keeping the drawings simple).
Figure 10:
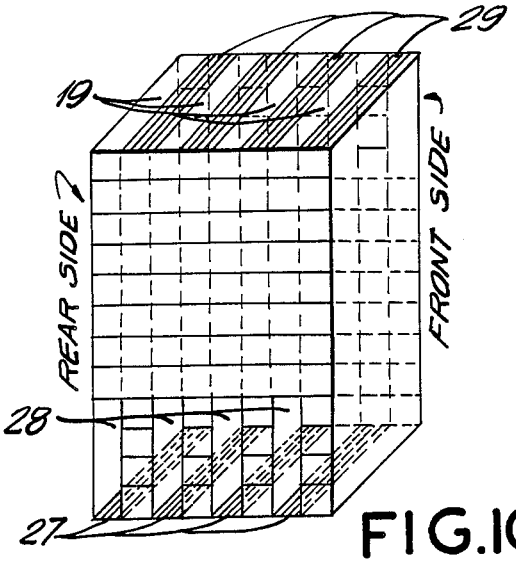
FIG. 10 shows FIG. 9 from the rear side when a part of rear side of the canals is closed to provide exhaust valves.
Figure 11:
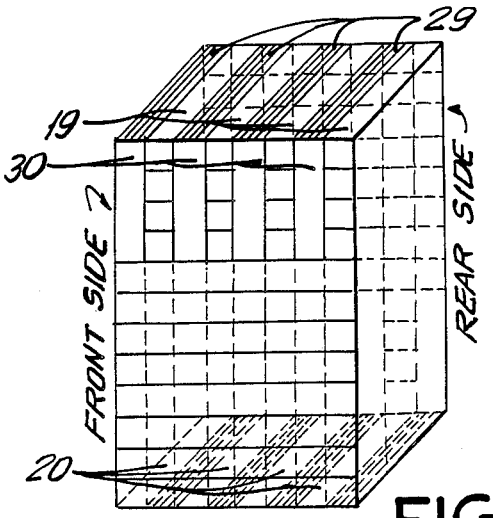
FIG. 11 shows FIG. 9 from the front side when a part of the side of the canals is closed to provide suction valves.
Figure 12:
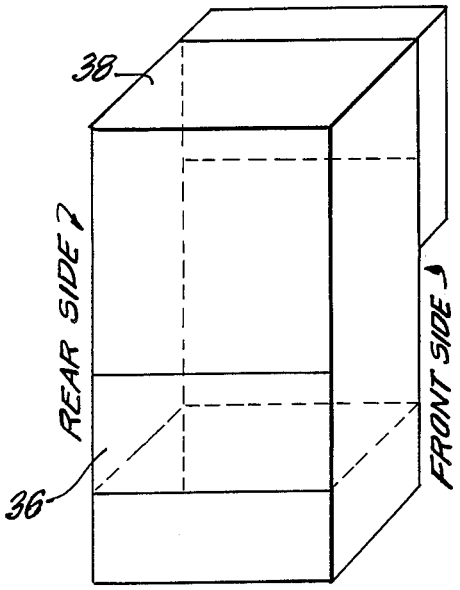
FIG. 12 shows the case of the heat exchanger from the rear side in which the canals which are shown in FIG. 10 will be inserted in it.
Figure 13:
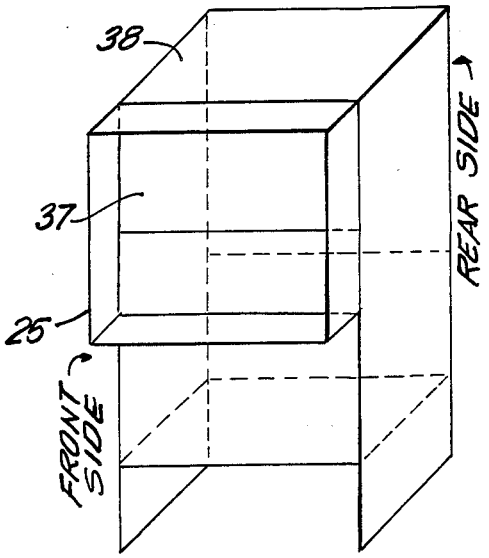
FIG. 13 shows the heat exchanger from the front side in which the the canals from the front side which are shown in FIG. 11 will be inserted in it.
Figure 14:
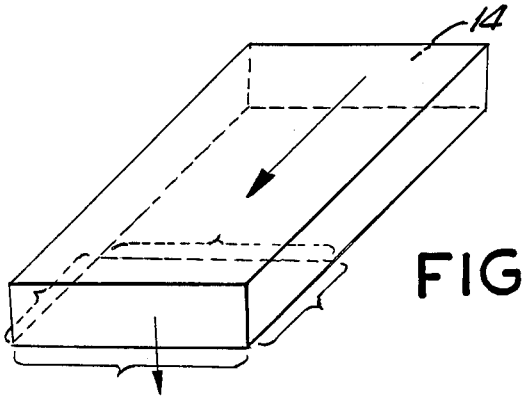
FIG. 14 shows a view of the connecting duct within the evaporative cooler.
Figure 1:
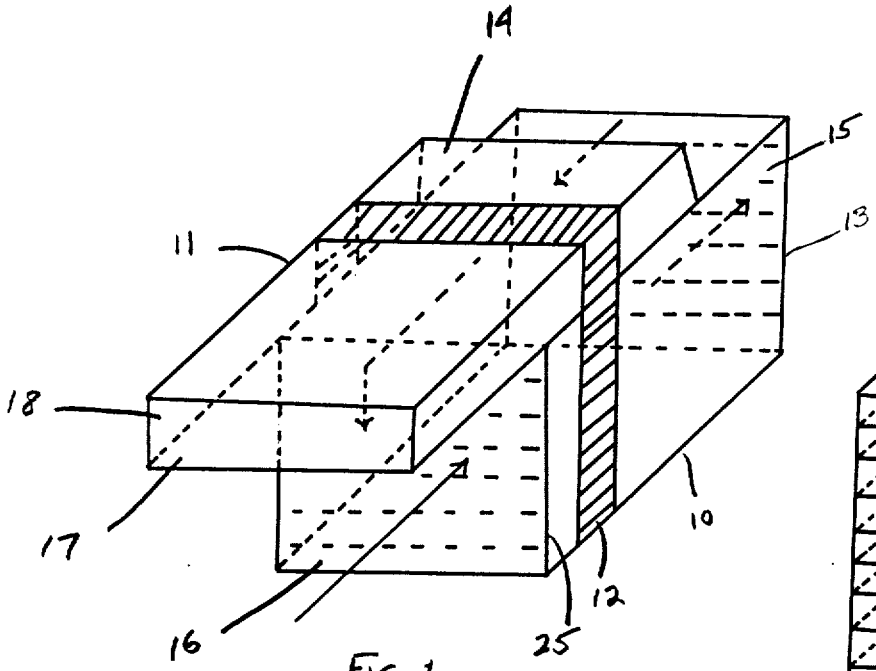
Figure 4:
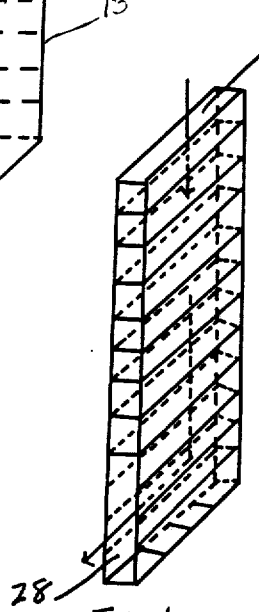
Figure 5:
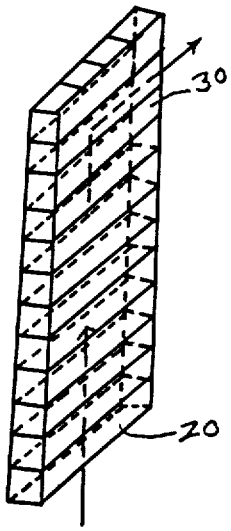
Figure 2:
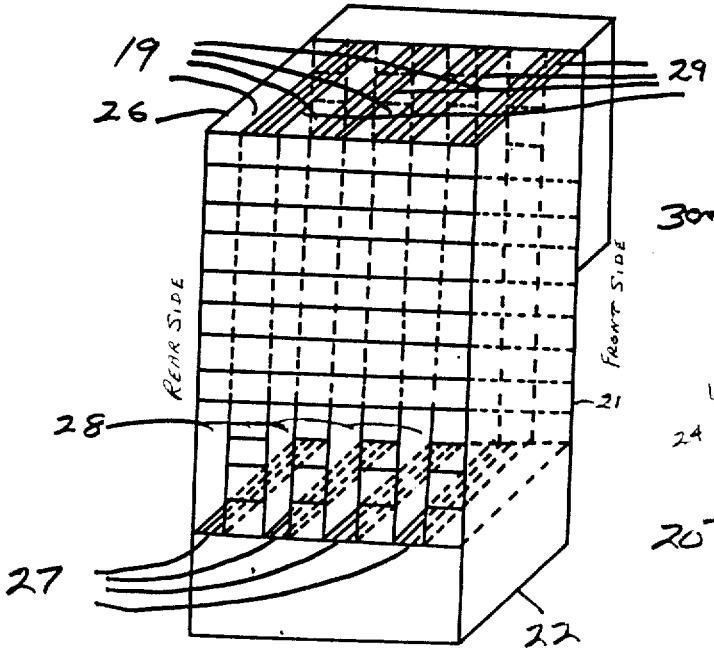
Figure 3:
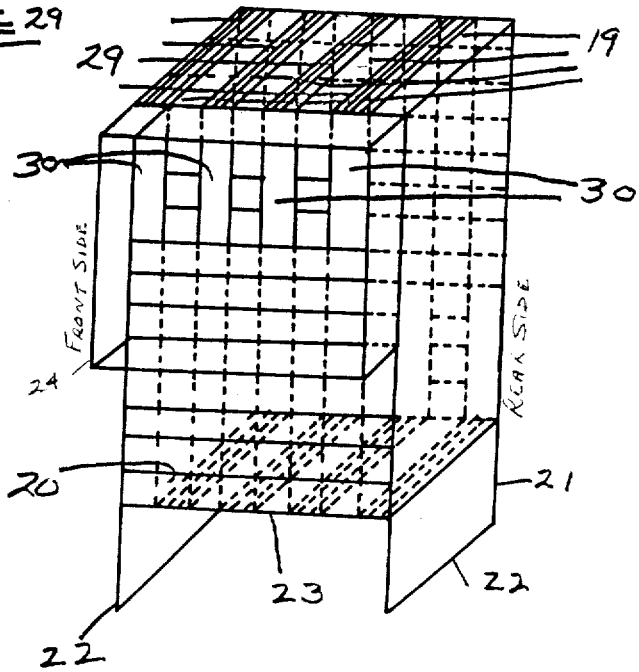
Figure 6:
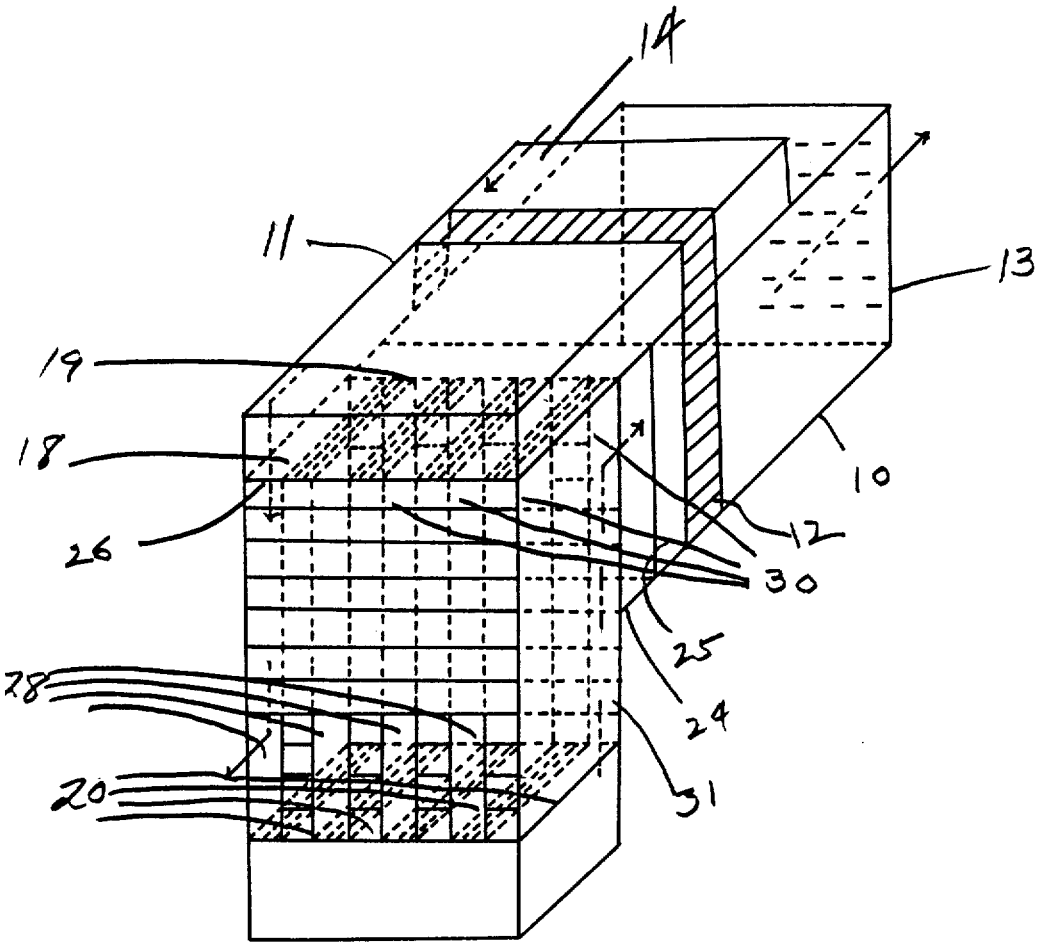
Figure 7:
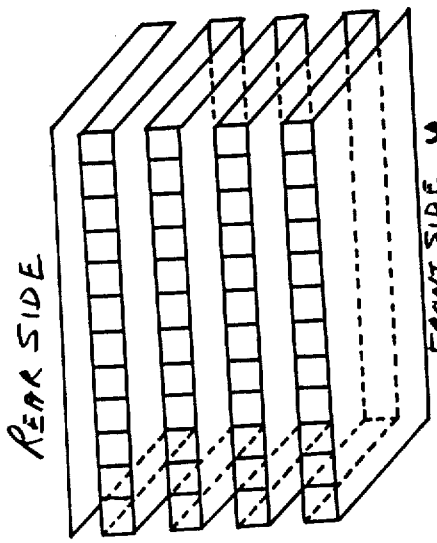
Figure 8:
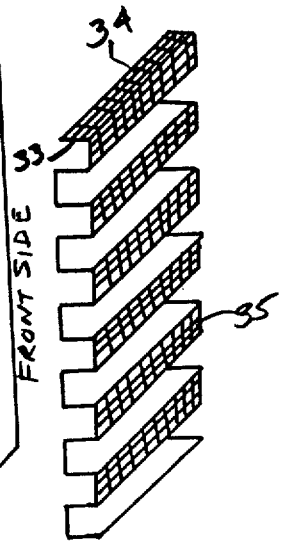
Figure 9:
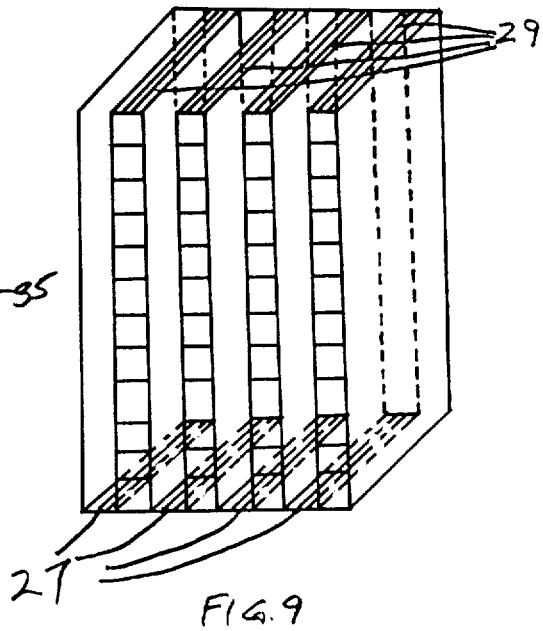

Referring to FIGS. 7–13 detail construction of the heat exchanger is shown. Initially the aluminum sheet is folded to make the canals in beginning stage as is shown in FIG. 7. Then aluminum sheet lace with good heat conductivity is bent to make the shape as is shown in FIG. 8 and is inserted into all canals (the aluminum lace inserted into the canals are not illustrated for the purpose to keep the drawing simple) thereby firstly preserving distance of the walls of the canals from each other and secondly as its wires which are parallel to the walls of the canals 33 will conduct the air toward the walls of the canals and as its wires 34 which extend between the walls of the canals and as some of its wires which attach the walls of the canals 35 makes a rough surface on the walls of the canals, helps heat exchange between the canals. The aluminum sheet and aluminum lace should be strong enough so that their shape do not change as the air is passing through the canals. Then the bottom of the exhaust canals 27 and the top of the suction canals 29 should be closed as is shown in FIG. 9 (aluminum lace inserted in the canals is not illustrated for the purpose of keeping the drawing simple. FIG. 9 shows the rear side of the canals. Now we leave free the lower part of the rear side equal to the length of the exhaust valves 28 and we seal the remainder of the rear side surface by a cardboard or aluminum sheet to shape out the set as is shown in FIG. 10 in which the exhaust valve 28 could be seen. We carry out the same process in the front side of the set, the only difference being that in this case we leave free the upper part of the front side equal to the length of the suction inlet opening 30 and we seal the remainder of the front side surface by a cardboard or aluminum sheet to shape out the set as is shown in FIG. 11 in which the suction inlet opening could be seen 30. There after the mentioned set is inserted in a case as is shown in FIGS. 12 and 13. The set is fitted in the case in such a way to have the exhaust outlet opening 28 aligned along the corresponding exhaust slot 36 in the case and suction inlet opening 30 aligned along the corresponding suction slot 37 in the case and the top of the canals 19 and 29 aligned along the corresponding top of the case 38. The material of the case should not be good heat conductivity. The canals should be fitted in the case air tight at the places of contact.

I claim:

1. A combination heat exchanger, reverse channels and cooler for cooling and dehumidifying outdoor air which comprises:

(a) a heat exchanger comprising a plurality of generally vertically disposed channels, said channels consisting of suction channels for flow of fresh useful air, exhaust channels for flow of precooled indoor air an outlet opening in said suction channel and an outlet opening in said exhaust channel, (b) a reverse channel for passage of precooled indoor air, said reverse channel having a distal open end for introduction of precooled indoor air and a proximal end disposed over the top of said exhaust channels wherein the precooled indoor air is diverted from said reverse channel into said exhaust channels, (c) each of said exhaust channels having an open top end and a closed bottom end, and each of said suction channels having a closed top end and an open bottom end, with said fresh outdoor air being conducted through said suction channels for indirect heat exchange with said precooled indoor air passing through said exhaust channels, and (d) a cooler disposed below said reverse channel and fixed to said heat exchanger such that said fresh outdoor air after heat exchange with said precooled indoor air enters said cooler wherein said fresh outdoor air is evaporatively cooled before discharge outside of said cooler.

2. A combination heat exchanger and cooler as in claim 1, wherein aluminum folded sheet lace is provided in each of said channels having wires disposed parallel to the channels for directing the air toward the walls of said channels; wires extending between the walls of said channels and attached thereto to maintain the distance between the walls and to impart rough surface to the walls to promote heat exchange.

3. A combination heat exchanger and cooler and as in claim 2 wherein said heat exchanger is made of aluminum sheet and each exhaust channel is separated by a wall from its adjacent suction channel.

* * * * *

UNITED STATES PATENT AND TRADEMARK OFFICE

CERTIFICATE OF CORRECTION

PATENT NO. : 4,793,152

DATED : December 27, 1988

INVENTOR(S) : Mohammed T. Naderi

It is certified that error appears in the above—identified patent and that said Letters Patent is hereby corrected as shown below:

Figures 1-9, inclusive, are cancelled and replaced with corrected Figures 1-9.

The title page should be deleted to appear as per attached title page.

Signed and Sealed this

Fourth Day of September, 1990

*Attest:*

HARRY F. MANBECK, JR.

*Attesting Officer*

*Commissioner of Patents and Trademarks*

United States Patent [19]

Naderi

[11] Patent Number: 4,793,152

[45] Date of Patent: Dec. 27, 1988

[54] EVAPORATIVE COOLER WITH VENTILATIVE DEVICE

[76] Inventor: Mohammod T. Naderi, Escamplaan 23, The Hague, Netherlands

[21] Appl. No.: 717,433

[22] Filed: Jun. 24, 1985

[51] Int. Cl.[4] ..... F28D 5/00

[52] U.S. Cl. ..... 62/311; 62/314

[58] Field of Search ..... 62/304, 309, 314, 311, 62/171

[56] References Cited

U.S. PATENT DOCUMENTS 4,023,949 5/1977 Schlom et al. ..... 62/314

4,429,735 2/1984 Nomaguchi et al. ..... 62/304

FOREIGN PATENT DOCUMENTS 5774582 5/1982 Japan ..... 62/304

*Primary Examiner*—Henry A. Bennet

[57] ABSTRACT

Fresh inlet air is precold by the cool air discharging from the enclosure by the means of a heat exchanger to become still colder as the result of evaporation inside the evaporative cooler so producing useful air colder and with less water than conventional evaporative cooler. A heat exchanger is disclosed which comprises of numerous exhaust and suction canals adjacent to each other in which is provided aluminium lace for the purpose of exchanging the heat. The cool discharged air passes through the exhaust canals and leaves the heat exchanger cool to outside space and inlet fresh air passes through the suction canals separately relationship with discharged air and after becoming cool leaves the heat exchanger inside the evaporative cooler to effect evaporation.

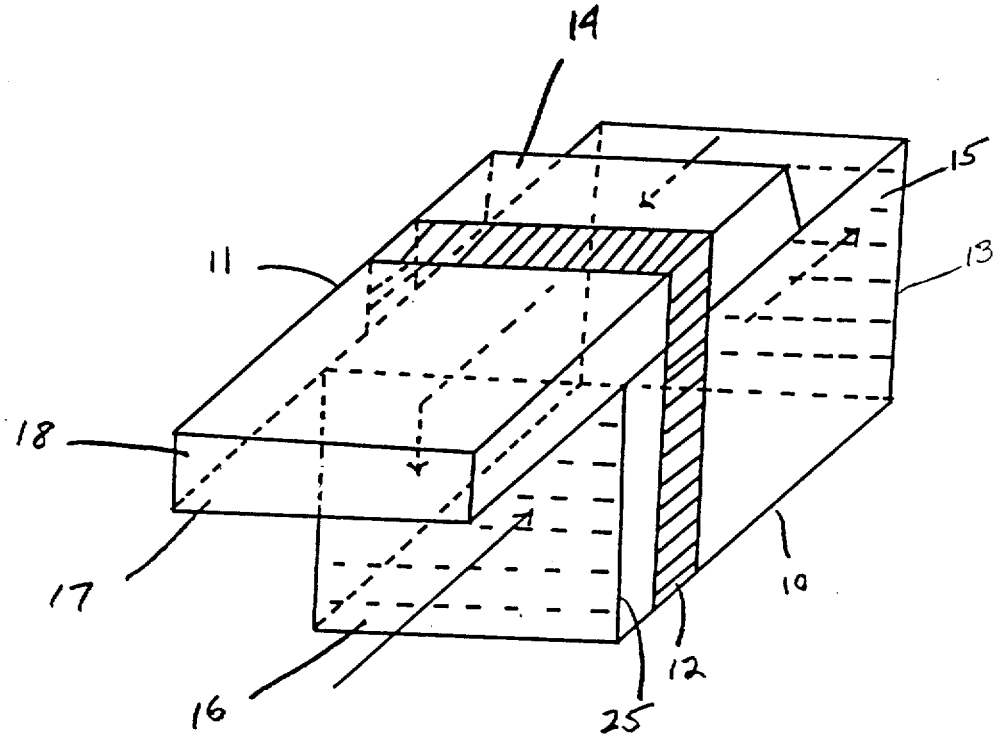

3 Claims, 2 Drawing Sheets